US005813050A

United States Patent [19]

Popowski

[11] Patent Number: 5,813,050

[45] **Date of Patent: *Sep. 29, 1998**

[54] WRIST GUARD

[75] Inventor: Sherry S. Popowski, Minneapolis, Minn.

[73] Assignee: Rollerblade, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 852,359

[22] Filed: May 7, 1997

[51] Int. Cl.[6] ..... A41D 13/08

[52] U.S. Cl. ..... 2/16; 2/162

[58] Field of Search ..... 2/16, 162, 20, 2/161.1; 473/62; 602/21, 64

[56] References Cited

U.S. PATENT DOCUMENTS

| | | | |
|---|---|---|---|
| D. 238,520 | 1/1976 | Bernstein . | |
| D. 239,220 | 3/1976 | Norman . | |
| D. 295,897 | 5/1988 | Thimm-Kelly . | |
| D. 327,753 | 7/1992 | Banks . | |
| D. 335,368 | 5/1993 | Houston . | |
| D. 360,059 | 7/1995 | Kalvestran et al. . | |
| D. 361,869 | 8/1995 | Paffett et al. . | |
| D. 379,678 | 6/1997 | Rosado . | |
| D. 385,669 | 10/1997 | Oetting . | |
| 2,794,638 | 6/1957 | Risher et al. . | |
| 3,228,035 | 1/1966 | Davis . | |
| 3,598,408 | 8/1971 | Klose . | |
| 4,011,596 | 3/1977 | Chang . | |
| 4,183,098 | 1/1980 | Knowles, Jr. . | |
| 4,843,651 | 7/1989 | Gramza et al. . | |
| 4,905,321 | 3/1990 | Walunga . | |
| 5,295,269 | 3/1994 | Ballard . | |
| 5,313,667 | 5/1994 | Levine | 2/16 |
| 5,435,007 | 7/1995 | Kalvestran et al. . | |
| 5,445,566 | 8/1995 | Hayes | 2/16 X |
| 5,566,389 | 10/1996 | Li | 2/16 |
| 5,600,849 | 2/1997 | Hu . | |

OTHER PUBLICATIONS

"Rollerblade® Spring '89", Rollerblade, Inc., 1989, Brochure.

*Primary Examiner*—Michael A. Neas
*Attorney, Agent, or Firm*—Merchant, Gould, Smith, Edell, Welter & Schmidt, P.A.

[57] ABSTRACT

A wrist guard is disclosed having first and second rigid members to be positioned over the back and front, respectively of a user's hand. The first and second rigid members are joined by flexible straps to permit an adjustment of a spacing between the first and second rigid member. Each of the first and second rigid members are symmetrical along the longitudinal axes of the first and second rigid members such that the wrist guard can be worn on either the left or right hand of a user without interfering with the flexing of the fingers or thumb of the user.

7 Claims, 2 Drawing Sheets

WRIST GUARD

I. BACKGROUND OF THE INVENTION

1. Field of the Invention

This invention pertains to protective wear for use in activities such as in-line skating or the like. More particularly, this invention pertains to a wrist guard for protecting a wrist and hand of a user during such activities.

2. Description of the Prior Art

In-line skating has become very popular. In order to protect a skater from injuries resulting from falls, skaters typically wear protective gear such as helmets, knee guards and wrist guards.

A wrist guard limits backward flexing of the hand relative to the forearm to reduce the risk of hyperextension of the wrist in the event of a fall. Further, wrist guards typically include an abrasive pad or the like in the palm region of the hand to protect the palm from abrasion.

Numerous designs of wrist guards are available. However, many such designs are cumbersome to use and uncomfortable to wear. Further, prior art wrist guards are dedicated to either the left or right hand of the user. Namely, a wrist guard designed for the right hand of the user can not be comfortably used on the left hand of the user. The absence of interchangeability between the left and the right hands is particularly frustrating for children who may frequently attempt to wear the left wrist guard on the right hand and visa versa. Where wrist guards are uncomfortable or awkward to put on or use, a skater may, out of frustration, elect not to wear a wrist guard.

It is an object of the present invention to provide a wrist guard which is comfortable to wear and easy to use. It is a further object of the present invention to provide such a wrist guard which is interchangeable for use on either the right and left hands of the user.

II. SUMMARY OF THE INVENTION

According to a preferred embodiment of the present invention, a wrist guard includes first and second rigid members each having longitudinal axes extending from a front end to rear end. The first rigid member has a length selected for its front end to be disposed at a knuckle line at the back of a user's hand and extending centrally along the back of the hand beyond the wrist of the user for the rear end to be disposed over a back side of a forearm of the user. The side edges of the first rigid member are symmetrical about the longitudinal axis of the first rigid member. The second rigid member has a length selected for the front end to be disposed at a first joint line of a palm of the user's hand and with the front end extending centrally along the palm with the total length of the second rigid member being less than the length of the first rigid member. The side edges of the second rigid member are symmetrical about the longitudinal axis of the second rigid member. Fastener straps join the front ends and the wrist portions of the first and second rigid members in parallel spaced-apart alignment. The straps are adjustable to permit the user to selectably adjust a spacing between the first and second rigid members. Opposing edges of the strap members define spaces on opposite sides of the rigid members with the spaces sized to pass the thumb of the user.

III. BRIEF DESCRIPTION OF THE DRAWINGS

IV. DESCRIPTION OF THE PREFERRED EMBODIMENT

With reference now to the various drawing figures in which identical elements are numbered identically throughout, a description of the preferred embodiment will now be provided.

Figure 3:
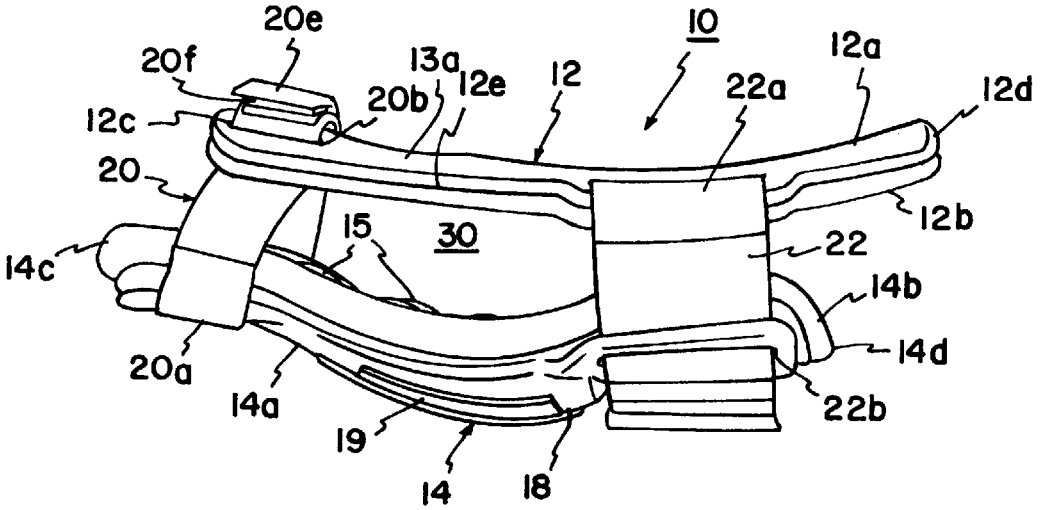
FIG. 3 is a side elevation view of a wrist guard of the present invention.

The present invention is directed to a wrist guard 10 which includes a back (or first) rigid member 12 and a front (or second) rigid member 14. The first and second rigid members 12, 14 are disposed in generally parallel spaced-apart alignment as best shown in FIG. 3. Each of the rigid members 12, 14 includes a rigid plastic shell 12*a*, 14*a* which is abrasion resistant. The members 12, 14 further include a padded inner liner 12*b*, 14*b* for comfort against a user's skin. The liner 14*b* includes a plurality of molded domes 15 to space the liner 14*b* from the palm to permit air circulation.

Figure 1:
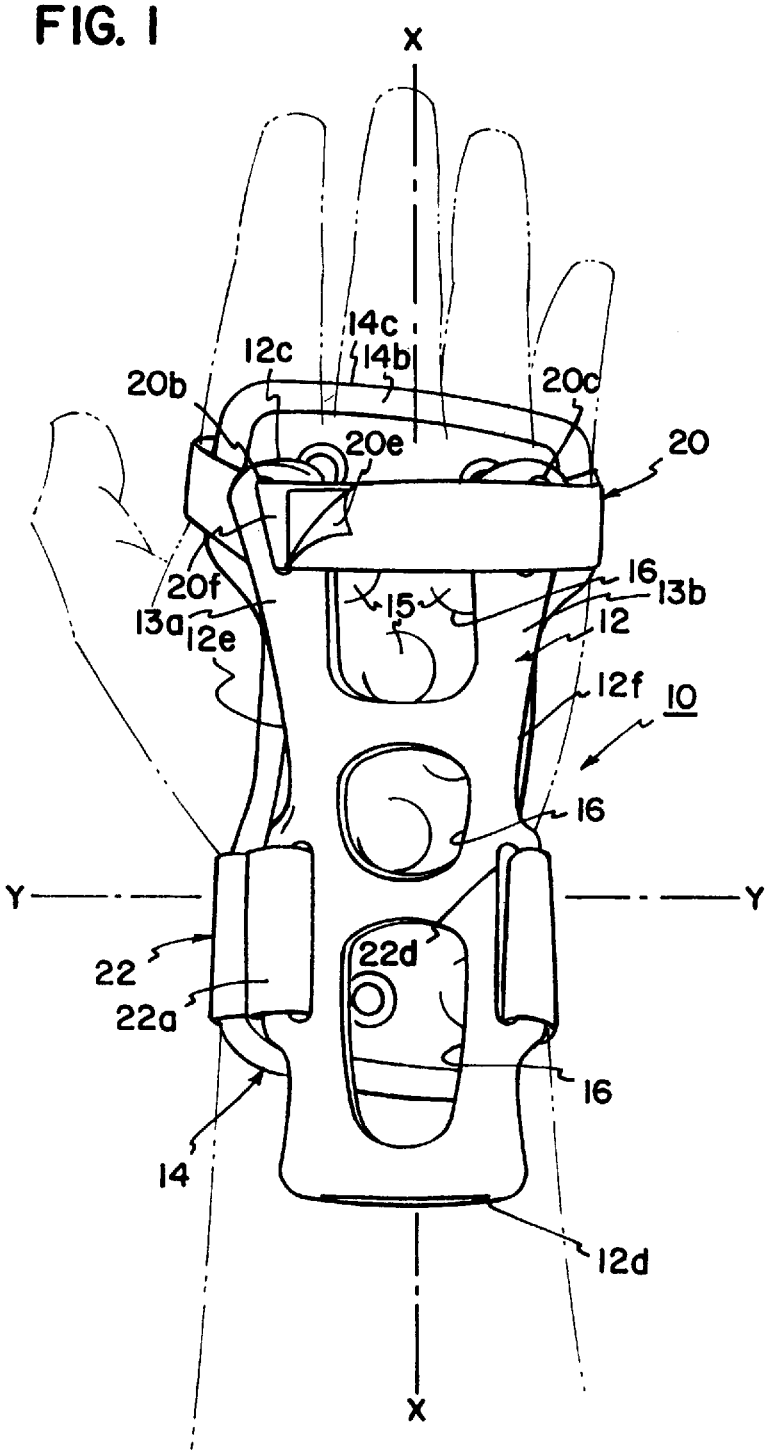
FIG. 1 is a plan view showing a back side of a wrist guard according to the present invention shown in use on a wearer's arm and hand with the wearer's arm and hand shown in phantom lines.
Figure 2:
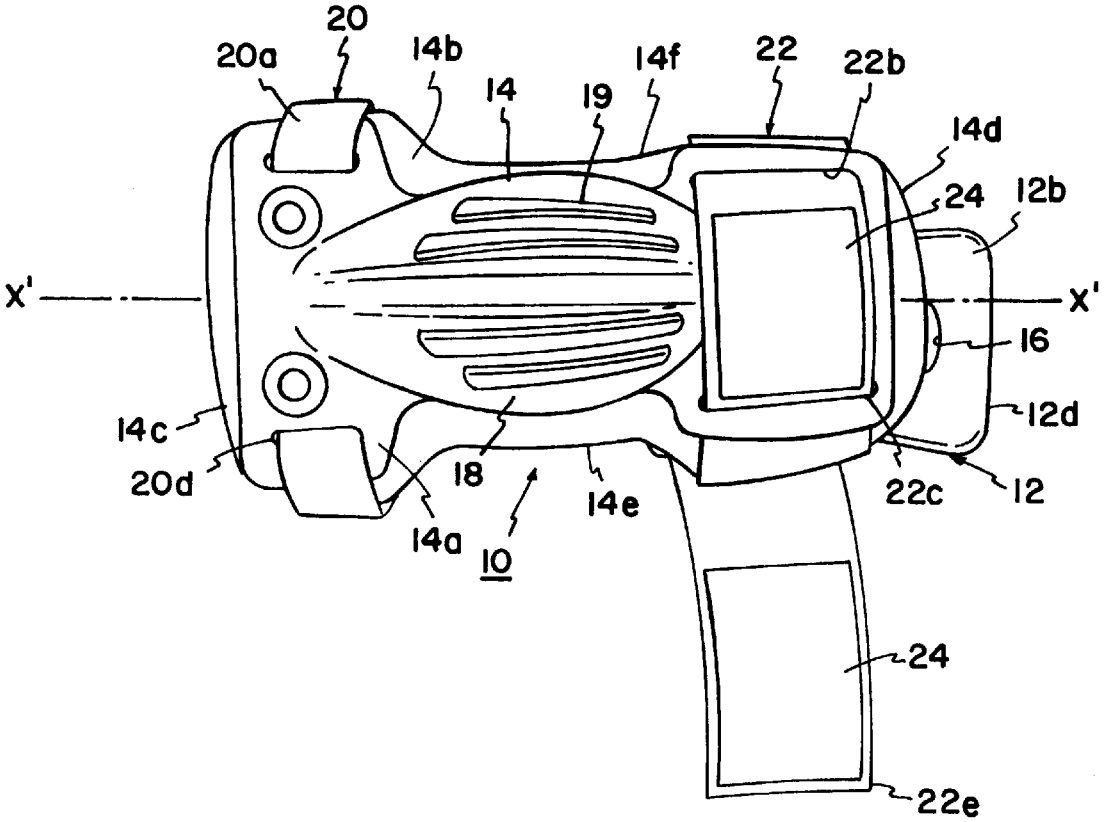
FIG. 2 is a plan view of a front side of the wrist guard of the present invention.

The first rigid member 12 has a first longitudinal axis X—X (FIG. 1) extending from a front end 12*c* to a rear end 12*d*. The front end 12*c* is disposed along the knuckle line (i.e., the knuckles where the user's fingers are jointed to the user's hand). The first end 12*c* has a transverse length perpendicular to axis X—X less than the width of the user's hand.

The first rigid member extends centrally along the back of the user's hand and beyond a pivoting wrist area Y—Y (FIG. 1) to the rear end 12*d* which is disposed over a back side of a forearm of the user. Side edges 12*e*, 12*f*, extend from the front end 12*c* to the rear end 12*e* and are symmetrical about the first longitudinal axis X—X. The edges 12*e*, 12*f* are spaced from the longitudinal axis X—X such that the thumb is freely flexible and flexing of the thumb is not interfered with by the edges 12*e*, 12*f* regardless of whether the first rigid member is positioned over the back of a left or right hand of the user.

Both the rigid plastic portion 12*a* and foam portion 12*b* are provided with a plurality of cutouts 16 disposed along axis X—X to permit air to freely circulate to the back of the user's hand for comfort and cooling. At the front end 12*c*, the first rigid member 12 is forked to present two spaced-apart ribs 13*a*, 13*b*, which are disconnected at the front end 12*c*. In the event of a skater's fall, the ribs 13 may flex apart slightly to absorb part of the force of the fall.

The second rigid member 14 extends from a front end 14*c* to a rear end 14*d* along a second longitudinal axis X'—X'. The front end 14*c* is disposed along a palm of the user's hand with the front end 14*c* disposed adjacent a first joint line along the palm (i.e., the joint line where the user's fingers are jointed to the user's hand). The length of the second rigid member 14 is less than the length of the first rigid member 12 to permit the user to have greater downward flexing of the wrist than upward flexing of the wrist.

The second rigid member 14 includes side edges 14*e*, 14*f* which are spaced from the second axis X'—X' by a distance sufficient to permit downward flexing of the user's thumb without interference regardless of whether the wrist guard 10 is worn on the right or left hand of the user. The side edges 14*e*, 14*f* are symmetrical about axis X'—X'.

The second rigid member 14 includes a convex cup 18 disposed in the heel region of the user's hand to accommodate the heel region of the user's hand. Preferably, abrasive resistant pads 19 are provided in the cup portion 18 to add additional abrasion protection.

First and second straps 20, 22 are provided. The straps permit the user to selectively adjust the spacing between the first and second rigid members 14. The first strap 20 is provided at the front ends 12*c*, 14*c*.

The strap 20 has a first end 20*a* secured to the front end 14*c* at edge 14*f*. The strap 20 passes through a slot 20*b* in the upper rigid portion 12 at rib 13*a* and passes across the upper rigid portion 12 to a second slot 20*c* at rib 13*b*. The strap 20 then passes through a slot 20*d* in the second rigid portion 14 (at front end 14*c* of edge 14*e*) with a free end 20*e* of the strap 20 folded over the portion of the strap 20 passing between slots 20*b*, 20*c*. Opposing portions of the strap between slots 20*b*, 20*c* are provided with mating hook and loop fasteners 20*f* to permit the user to fasten strap 20 in any one of a plurality of fixed positions to adjust the spacing between the front ends 12*c*, 14*c*.

Strap 22 is provided surrounding a wrist portion of the user adjacent end 14*b*. A first end 22*a* of the strap 22 is secured to the upper rigid portion 12 at edge 12*e*. The strap passes through a slot 22*b* in the lower rigid portion 14 adjacent edge 14*f*. The strap 22 then passes through a second slot 22*c* in the lower rigid portion 14 adjacent edge 14*e* and subsequently passes through a slot 22*d* in the upper rigid portion adjacent edge 12*f*.

A free end 22*e* of the strap 22 can be folded over the portion of the strap extending between slots 22*b*, 22*c*. Opposing portions of the strap 22 are provided with mating hook and loop fasteners 24 to permit a user to fasten the strap 22 in any one of a plurality of releasable fixed positions in order to adjust a spacing between the rigid members 12, 14 at the wrist portion of the wrist guard 10. Opposing edges of the straps 20, 22 define spaces 30 on both sides of the wrist guard 10 with the spaces 30 sized to freely pass a thumb of the user.

With the construction thus described, the wrist guard can be worn on either the right or the left hand with the thumb passing through the spaces 30 and having free flexing motion regardless of whether the wrist guard 10 is worn on the right or the left hand of the user. The wrist guard 10 permits the user's fingers to have full flexing capabilities in order to increase the comfort of the user. The heel of the hand is contained within the cup 18 for both comfort and positioning in the event of impact. Since the plastic 12 is only slightly flexible, the rigid plastic member having its end 12*d* disposed over the back of the forearm greatly restricts upward flexing of the hand relative to the forearm to prevent hyperextension of the wrist in the event of a fall. The symmetrical nature of the rigid members 12, 14 with respect to the longitudinal axes X—X and X'—X' further facilitates the use of the wrist guard 10 on either the right of the left hand to avoid frustration when attempting to wear the wrist guard 10 or to avoid improper use.

When the foregoing detailed description of the present invention has been shown of the objects of the invention have been attained in the preferred manner. Modifications and equivalents of the disclosed concepts are intended to be included within the scope of the claims which are appended hereto.

What is claimed is:

1. A wrist guard comprising:

a first rigid member having:

a first longitudinal axis extending from a front end to a rear end;

a length selected for said front end to be disposed at a knuckle line of a back of a user's hand with said first rigid member extending centrally along said back of said hand and beyond a wrist of said user for said rear end to be disposed over a back side of a forearm of said user;

side edges extending from said front end to said rear end and symmetrical about said first longitudinal axis;

a second rigid member having:

a second longitudinal axis extending from a front end to a rear end;

a length selected for said front end to be disposed at a first joint line of a palm of a user's hand with said second rigid member extending centrally along said palm of said hand and with said length of said second rigid member less than said length of said first rigid member;

side edges extending from said front end to said rear end and symmetrical about said second longitudinal axis;

said first and second rigid members disposed in parallel spaced-apart alignment;

a fastener including:

a first strap adjacent said front ends of said first and second rigid members having a free end releasably secured in any one of a plurality of fixed positions to selectively adjust a spacing between said front ends;

a second strap connecting said first and second rigid members at said wrist and having a free end releasably secured in any one of a plurality of fixed positions to selectively adjust a spacing between said first and second rigid members at said wrist;

opposing edges of said first and second straps defining spaces on opposite sides of said rigid members with each of said spaces sized to pass a thumb of said user.

2. A wrist guard according to claim 1 wherein said first rigid member has a transverse width less than a width of said hand.

3. A wrist guard according to claim 1 wherein said second rigid member has a cup portion disposed at a heel of said palm.

4. A wrist guard according to claim 1 wherein said second rigid member has a transverse width less than a width of said palm.

5. A wrist guard according to claim 1 wherein said side edges of said first rigid member are spaced from said first longitudinal axis by a spacing to permit full flexing of a thumb of said user between said first and second straps.

6. A wrist guard according to claim 1 wherein said side edges of said second rigid member are spaced from said second longitudinal axis by a spacing to permit full flexing of a thumb of said user between said first and second straps.

7. A wrist guard comprising:

a first rigid member having:

a first longitudinal axis extending from a front end to a rear end;

a length selected for said front end to be disposed at a knuckle line of a back of a user's hand with said first rigid member extending centrally along said back of said hand and beyond a wrist of said user for said rear end to be disposed over a back side of a forearm of said user;

side edges extending from said front end to said rear end and spaced from said first longitudinal axis by a spacing to permit full flexing of a thumb of said user;

a second rigid member having:

a second longitudinal axis extending from a front end to a rear end;

a length selected for said front end to be disposed at a first joint line of a palm of a user's hand with said second rigid member extending centrally along said palm of said hand and with said length of said second rigid member less than said length of said first rigid member;

side edges extending from said front end to said rear end and spaced from said second longitudinal axis by a spacing to permit full flexing of a thumb of said user;

said first and second rigid members disposed in parallel spaced-apart alignment;

a fastener including:

a first strap adjacent said front ends of said first and second rigid members having a free end releasably secured in any one of a plurality of fixed positions to selectively adjust a spacing between said front ends;

a second strap connecting said first and second rigid members at said wrist and having a free end releasably secured in any one of a plurality of fixed positions to selectively adjust a spacing between said first and second rigid members at said wrist;

opposing edges of said first and second straps defining spaces on opposite sides of said rigid members with each of said spaces sized to pass a thumb of said user.

* * * * *